United States Patent [19]

Hinsche et al.

[11] B 4,005,954

[45] Feb. 1, 1977

[54] PRODUCTION OF PLASTER FLOORS BY THE FLOODING PROCESS

[75] Inventors: Friedrich Hinsche, Leverkusen-Kueppersteg; Kurt Schaupp, Cologne, both of Germany

[73] Assignee: Bayer Aktiengesellschaft, Leverkusen, Germany

[22] Filed: Apr. 10, 1974

[21] Appl. No.: 459,821

[44] Published under the second Trial Voluntary Protest Program on March 30, 1976 as document No. B 459,821.

[30] Foreign Application Priority Data

Apr. 16, 1973 Germany ..... 2319069

[52] U.S. Cl. ..... 428/537; 52/515; 52/744; 156/71; 427/299; 428/538

[51] Int. Cl.[2] ..... E04B 5/00

[58] Field of Search ..... 117/70 R, 70 S, 92, 117/169 R, 169 A; 156/62.2, 71; 161/208, 209; 264/112, 113, 117; 52/515, 516, 744; 427/299; 428/537, 538

[56] References Cited

UNITED STATES PATENTS

| | | | |
|---|---|---|---|
| 825,870 | 7/1906 | Schirra | 117/70 R |
| 1,664,638 | 4/1928 | Mitter | 52/516 X |
| 2,307,696 | 1/1943 | Blair-McGuffie | 117/70 R |
| 2,362,060 | 11/1944 | Etridge et al. | 161/209 X |
| 3,389,042 | 6/1968 | Bieri et al. | 161/209 X |
| 3,694,298 | 9/1972 | Veschuroff et al. | 117/11 X |

*Primary Examiner*—Michael R. Lusignan
*Attorney, Agent, or Firm*—Burgess, Dinklage & Sprung

[57] ABSTRACT

In the process for producing a plaster flooring having a flat and smooth surface by the flooding technique, in which an inorganic binder is made up into a fluid paste by the addition of water and said fluid paste is applied to a surface to be covered, the improvement which comprises providing a water-absorbent layer on said surface to be covered prior to application of said fluid paste.

7 Claims, No Drawings

PRODUCTION OF PLASTER FLOORS BY THE FLOODING PROCESS

It is known that plaster flooring having hard, completely flat and horizontal surfaces can be obtained in a single operation by means of a simple flooding process from calcium sulfate-containing binders, optionally in the presence of additives and with the aid of special auxiliary substances such as water-soluble polysaccharides. In this process, the binder-containing paste used for producing the plaster flooring must be sufficiently fluid to enable it to spread out freely under the action of gravity alone. A flat and horizontal surface is then formed naturally.

In a similar manner, a mortar or a binder paste which has not been diluted can be prepared from anhydrite with the addition of special auxiliary substances so as to produce such a liquid consistency so that it finds its own level in the same way as water. In this way flooring plasters are produced, for example, in which the surface becomes smooth and horizontal without the use of any mechanical aids. In the same way manufactured elements such as tiles may be cast from the above mentioned fluid binder compound.

In the process mentioned above, the fluidity of the mortar compound is usually obtained by using special chemical auxiliary substances. With the aid of these auxiliary substances, the water-binder factor which determines the fluidity of the mortar or binder paste can be kept just sufficiently high to ensure that the products will have the required mechanical strength properties. Thus, according to German DOS No. 1,943,634 the fluidity of a mortar compound of anhydrite is increased by the addition of a water-soluble cellulose ether which retards sedimentation so that the mortar spreads out rapidly and uniformly on its support. In addition, an auxiliary substance is used in the said DOS to increase the strength, this substance, for example, being in the form of a sulfite-modified or sulfonic acid-modified resin based on an amino-s-triazine (=modified melamine resin) having at least two amino groups, which enables the anhydrite mortar to be made up with a larger quantity of water and therefore adjusted to a fluid consistency.

A particular disadvantage of this method is that the amount of chemical auxiliary substances required for the process, as well as the quantity of water required for making the paste must be very accurately adjusted to the particular anhydrite used. If this is not done, serious disadvantages and damage may occur, e.g., in the form of cracks, peeling of the surface, insufficient strength and unduly long hardening times. Furthermore, the necessary use of relatively expensive chemical auxiliary substances makes this process expensive despite the saving in labor. In another process, anhydrite, water and suitable additives are made up in a high speed mixer into a highly fluid paste, using a proportion by weight of mixing water to anhydrite (binder) of 0.25–0.40 : 1. The proportion by weight of water to binder in the fluid paste is defined as the water-binder factor. When this mixture is poured out, it has a flow angle of from 0° to 30°C. A flat and smooth surface is obtained by means of a vibrator and/or by using a smoothing machine (German DOS No. 2,107,484). In this process, although the anhydrite compound can be applied without the need of great labor and without the use of special expensive chemical auxiliary substances, mechanical treatment is necessary during or after laying of the compound in order to obtain a completely smooth and flat surface and so the saving in labor achieved in applying the anhydrite compound is not sufficient to result in an overall saving in cost.

It is accordingly an object of the invention to provide a simple way of producing a plaster flooring by the flooding technique without the need for expensive chemical auxiliaries, and this object is realized by providing a water-absorbent layer on the surface to be covered prior to application thereto of a fluid paste comprising an inorganic binder which is to constitute the plaster flooring.

By the process according to the invention, plaster floorings having a flat and smooth surface can be obtained without the aid of chemical auxiliary substances and without mechanical surface treatment if a binder paste, either diluted or undiluted, is mixed with sufficient water to form a compound which flows easily. The fluid compound prepared according to the invention will hereinafter be referred to as "levelling compound." The levelling compound is poured out on a support which is capable of absorbing water. The levelling compound fills up any irregularities of the surface by flowing freely and it solidifies within hours to form a solid mass having a flat, smooth surface. An inorganic binder which has been found to be particularly suitable is anhydrite, either of synthetic or natural origin, having a water-binder factor in the binder paste of about 0.38 to 0.75, preferably about 0.45 to 0.60. Such an anhydrite binder paste can easily be prepared either batchwise or continuously, for example in a high speed mixer. A creamy, homogeneous suspension is obtained which may advantageously be pumped from the mixer directly to the site of the weight bearing foundation to which has been applied the water-absorbent layer. It is also possible to use other binders, for example, cement, gypsum or magnesia cement. The binders used may be either undiluted or diluted with fillers such as fine sand, expanded clay, pumice or filter ash. The fillers may be used in quantities of about 10 to 300% by weight, preferably about 50 to 150% by weight, based on the binder. Preferably, however, the binder pastes are used undiluted.

The water absorbent layer employed is preferably made of a material which binds the absorbed water so firmly that it will not liberate the water even at an elevated temperature. Materials which set when they absorb water are advantageously used for this purpose, for example gypsum, natural or synthetic anhydrite, cement or mixtures of these substances which combine with the absorbed water to form compounds of great strength. The water absorbent material may be used either in powder form or in compact form, e.g., as a finely divided granulate or as a pressed plate.

The water absorbent layer according to the invention should be capable of absorbing the correct amount of water so that the excess water required to keep the levelling compound freely flowing will be absorbed leaving sufficient water for hydration of the binder, allowing also for the evaporation losses which inevitably occur. Furthermore, the layer should develop its full power of water absorption only when the levelling compound is no longer required to flow. This occurs when the levelling compound, after spreading out freely, has formed a layer of the required thickness for the plaster flooring and has acquired a flat and smooth surface. The required capacity of the water absorbent layer, i.e., the quantity of water absorbed, depends on the required thickness of the layer of plaster flooring and the water-binder factor of the levelling compound whereas the intensity, i.e., the rate of water absorption by the absorbent layer, depends on the surface/volume ratio of the levelling compound.

The thickness of the water-absorbent layer is therefore adjusted to the total quantity of water introduced with the levelling compound and this, as already mentioned above, depends on the water-binder factor of the levelling compound and the required thickness of the plaster flooring which is to be produced by the flooding process. The thickness of the water-absorbent layer which is used for different levelling compounds having different water-binder factors is therefore given in terms of the fraction of the quantity of solid applied with the levelling compound per unit surface area. Thus, for example, in the case of levelling compounds which have water-binder factors of about 0.38 to 0.75, the amount of material used as the water absorbent layer per unit surface area of the plaster flooring to be produced will amount to about 2.5 to 42% by weight of the quantity of solid substance applied per unit surface area with the levelling compound; the weight of the water absorbent layer will increase as the water binding factor of the levelling compound increases. In the case of levelling compounds which have a water-binder factor within the preferred range of about 0.45 to 0.60, the proportion by weight of the substance used, expressed as water absorbent layer per unit surface area, will be about 5 to 27% by weight of the quantity of solid substance introduced with the levelling compound per unit surface area. For levelling compounds having a water-binder factor within the particularly preferred range of about 0.50 to 0.55 the corresponding values for the proportions by weight of water absorbent layer are about 13 to 20% by weight.

In a preferred embodiment of the process according to the invention, the water absorbent layer is covered with a water-permeable separating layer. The following materials are suitable for this separating layer: Paper, cardboard, perforated plastic sheets, textile webs, layers of gravel or sand, or a material which is slowly dissolved by moisture (e.g., a water-soluble adhesive) during 15 – 60 minutes.

If the separating layer is made of a material which does not dissolve, the intensity, i.e., the rate of water absorption by the water absorbent layer, is determined by the permeability of this separating layer, which in turn is determined by its own absorbency and/or by the degree of perforation. If a slowly dissolving material is used for the separating layer, the rate of water absorption by the water absorbent layer depends on the absorbency and the rate of solution of the separating layer.

The choice of material used as the separating layer has some influence on the size of the surface over which the levelling compound should be poured by the flooding process, because the time of onset of absorption of the water from the levelling compound by the water absorbent layer depends upon the nature of the separating layer. The greater the interval between the time when the levelling compound is first applied and the time when the absorbent power of the water absorbent layer begins to act on the levelling compound, the greater can be the surface of plaster flooring formed (for a given thickness of plaster) because as soon as this interval, which depends on the material of separating layer used, has passed, free flow of the levelling compound can no longer be ensured. The compound must therefore be levelled out by the end of this time. The time interval between the moment when the levelling compound is applied to the water absorbent layer which is covered by a separating layer and the moment when the absorbent power of the water absorbent layer begins to act on the levelling compound through the separating layer will hereinafter be referred to as the "diffusion time" of the separating layer. The average diffusion times for various materials are as follows:

| | |
|---|---|
| Textile fabrics | 7–28 minutes |
| Paper | 10–35 minutes |
| Perforated plastic sheets | 15–50 minutes. |

Depending on these diffusion times, a mixing conveying apparatus operating at an output of 3 $m^3$ of levelling compound per hour can be used to cover the following surface areas with a plaster flooring 3 cm in thickness before the sucking action of the water absorbent layer inhibits or prevents free flow of the compound:

| Materials used as separating layer | | Area of surface in $m^2$ for which free flow can be ensured |
|---|---|---|
| Textile fabric | 7/28 min | ca. 10–44 |
| Paper | 10/35 min | ca. 15–55 |
| Perforated plastic sheets | 15/50 min | ca. 23–80 |

Plaster floorings can be produced on surfaces of any size by the process according to the invention since they may first be produced in separate areas the size of which depends on the given data regarding the influence of the material of separating layer and on the output of the mixing and conveyor apparatus used.

In everyday building practice, the plaster floorings are generally applied in a standard thickness. The most popular thicknesses for plaster floorings applied to a separating layer are 25 mm, 30 mm and 35 mm and for floating intermediate floorings 30 mm, 35 mm and 40 mm. The surface areas which for technical and economical reasons can suitably be covered by this process are between 25 and 80 $m^2$. If at the same time it is assumed that the levelling compounds used will in most cases be those which have the particularly preferred water-binder factors mentioned above, then all the parameters which determine the absorbent layer and separating layer will be known for all the cases which are most frequently encountered in practice. For these clearly defined cases, the water absorbent layer having a suitable thickness may be combined with the appropriate separating layer to form a prefabricated combined element, e.g., in the form of a panel or a mat. These prefabricated panels or mats can be machine produced, for example by introducing the layer of absorbent material of the desired thickness between a lower, impervious polyethylene sheet and an upper, perforated polyethylene sheet and then sewing or welding the two sheetings together at the edges.

Whereas flooring plasters with the above mentioned high water-binder factors produced by the previously known flooding processes require hardening times which are too long in practice and have little or practically no mechanical strength so being very liable to crack, the flooring plasters produced by the process according to the present invention have a flat and smooth surface and are distinguished by their rapid hardening and high strength. Another advantage of the process according to the invention is that the operation of applying the hardenable compound, which is rapid and labor saving compared with conventional methods of applying mortar, is achieved without requiring expensive inorganic or organic chemical auxiliary substances, although it would be possible to use them in this process. Such auxiliary substances include, for example, the modified melamine resins mentioned earlier or methyl cellulose, defoaming agents such as tributylphosphate or accelerators such as calcium sulfate dihydrate, etc..

The flooring plasters produced according to the invention are distinguished by having surfaces which are practically free from a sludge layer and are therefore particularly suitable as a foundation for floor coverings. Sludge layers occur in the conventional processes if the mortar applied is too wet and they may also occur in the new process described above if the quantities of individual components are not accurately adjusted to each other. They prevent proper adherence between the floor plaster and covering and are frequently the cause of serious damage.

The process according to the invention will be explained by way of example.

EXAMPLE

The floor and walls up to a height of 6 inches of a 7 × 8.5 m room is insulated with pitch and a water-proof polyethylene sheet is laid thereon. A 2 cm thick layer of dry anhydrite is then applied to the sheet and is then rolled or stamped down.

This anhydrite layer is covered with 1 m wide 0.3 mm thick perforated polyethylene sheets which overlap by 20 cm at the edges. The perforations of the sheets are 0.8 mm in diameter and are set 30 mm apart in all directions. A continuous mixing and conveyor machine is then used to pump on this prepared surface an anhydrite paste prepared from anhydrite binder and 52% by weight of water. This paste is applied to a level which is 4 mm above the desired level of the finished plaster flooring, which is required to have a thickness of 30 mm. This thin paste flows freely over the whole surface without any mechanical aid. About 30 minutes after pumping has been stopped, the whole paste which had been applied to the floor becomes stiff due to the withdrawal of water and is no longer capable of flowing freely. The level drops by about 4 mm to the desired level of the plaster flooring in the course of about 1 ½ hours due to the withdrawal of water which continues until the lower layer of anhydrite is saturated. At about this time, the anhydrite mass also begins to solidify. The plaster surface can be walked over after only 20 hours. After 14 days, the quantity of unbound water in the weight bearing plaster layer proper is 0.4% by weight and in the absorbent layer 0.8% by weight. After this time, the mechanical strength properties of the weight bearing layer are as follows: 53.8 kp/cm$^2$ flexural tensile strength and 276.0 kp/cm$^2$ compressive strength, these being measured on a test piece which has been cut out.

It will be appreciated that the instant specification and examples are set forth by way of illustration and not limitation, and that various modifications and changes may be made without departing from the spirit and scope of the present invention.

What is claimed is:

1. In the process for producing a plaster flooring having a flat and smooth surface by mixing an inorganic binder with water to form a fluid paste and applying said fluid paste to a surface to be covered so that said paste flows freely thereover, the improvements which comprise coating the surface to be covered with a water-absorbent layer prior to application of said fluid paste, said water-absorbent layer comprising at least one material selected from the group consisting of gypsum, natural anhydrite, synthetic anhydrite and cement and being used in 2.5 to 42% by weight of the solids in the fluid paste, said binder being an anhydrite which has a water-binder factor of about 0.38 to 0.75.

2. A process as claimed in claim 1, wherein the binder is an anhydrite which has a water-binder factor of about 0.45 to 0.60.

3. A process as claimed in claim 1, wherein prior to application of said fluid paste the waterabsorbent layer is covered with a separating layer through which the water can diffuse.

4. A process as claimed in claim 3, wherein the material used to form the separating layer comprises at least one material selected from the group consisting of paper, cardboard, a textile fabric, a perforated plastic sheet and a substance which is dissolved by the action of water.

5. A process as claimed in claim 3, wherein the water-absorbent layer of a suitable thickness and the appropriate separating layer are used together as a prefabricated combined element.

6. A plaster flooring produced by the process of claim 1.

7. A plaster flooring produced by the process of claim 4.

* * * * *